US010024139B2

(12) United States Patent
Edwards

(10) Patent No.: US 10,024,139 B2
(45) **Date of Patent: *Jul. 17, 2018**

(54) WELL BARRIER

(71) Applicant: Enovate Systems Limited, Aberdeen (GB)

(72) Inventor: Jeffrey Edwards, Aberdeen (GB)

(73) Assignee: Enovate Systems Limited, Aberdeen (GB)

( * ) Notice: Subject to any disclaimer, the term of this patent is extended or adjusted under 35 U.S.C. 154(b) by 92 days.

This patent is subject to a terminal disclaimer.

(21) Appl. No.: 15/042,986

(22) Filed: Feb. 12, 2016

(65) Prior Publication Data

US 2016/0177671 A1 Jun. 23, 2016

Related U.S. Application Data

(63) Continuation of application No. 13/583,353, filed as application No. PCT/GB2011/000343 on Mar. 10, 2011, now Pat. No. 9,297,233.

(30) Foreign Application Priority Data

Mar. 11, 2010 (GB) ..... 1003996.4

(51) Int. Cl.
*E21B 34/10* (2006.01)
*E21B 34/12* (2006.01)
(Continued)

(52) U.S. Cl.
CPC ..... *E21B 34/14* (2013.01); *E21B 34/10* (2013.01); *E21B 34/102* (2013.01); *E21B 34/12* (2013.01); *E21B 2034/005* (2013.01)

(58) Field of Classification Search
CPC .. E21B 2034/005; E21B 34/10; E21B 34/102; E21B 34/12; E21B 34/14
See application file for complete search history.

(56) References Cited

U.S. PATENT DOCUMENTS 2,780,290 A 2/1957 Natho ..... 166/72
3,151,839 A * 10/1964 Mott ..... E21B 34/12 166/334.1

(Continued)

FOREIGN PATENT DOCUMENTS

GB 2112041 A 7/1983
GB 2433523 A 6/2007
WO WO 2009/060233 A1 5/2009

OTHER PUBLICATIONS

International Search Report corresponding to International Application No. PCT/GB2011/000343.

(Continued)

*Primary Examiner* — Cathleen R Hutchins
(74) *Attorney, Agent, or Firm* — Myers Bigel, P.A.

(57) ABSTRACT

A well barrier for sealing a downhole conduit is described. The well barrier comprises a housing defining a throughbore having a longitudinal axis, a valve actuator and a flapper valve. The flapper valve includes a flapper attached to the valve actuator. The flapper valve and the valve actuator are axially movable with respect to the housing in a direction parallel to the longitudinal axis. The flapper is adapted to move from one of a throughbore open and throughbore closed positions to the other of said open and closed positions when the actuator and flapper valve move a predetermined axial distance.

13 Claims, 3 Drawing Sheets

(51) Int. Cl.
*E21B 34/14* (2006.01)
*E21B 34/00* (2006.01)

(56) References Cited

U.S. PATENT DOCUMENTS

| | | | | |
|---|---|---|---|---|
| 4,632,184 | A | 12/1986 | Renfroe, Jr. et al. | |
| 5,095,994 | A | 3/1992 | Dollison | |
| 5,251,702 | A * | 10/1993 | Vazquez | E21B 34/107 166/324 |
| 6,508,309 | B1 | 1/2003 | French | 166/323 |
| 6,957,703 | B2 | 10/2005 | Trott et al. | 166/332.8 |
| 7,967,076 | B2 * | 6/2011 | Kim | E21B 23/04 166/373 |
| 2003/0094285 | A1 | 5/2003 | French | E21B 21/00 166/380 |
| 2006/0162939 | A1 | 7/2006 | Vick, Jr. et al. | |
| 2007/0215361 | A1 * | 9/2007 | Pia | E21B 34/102 166/386 |

OTHER PUBLICATIONS

Written Opinion of the International Searching Authority corresponding to International Application No. PCT/GB2011/000343.

* cited by examiner

WELL BARRIER

RELATED APPLICATIONS

This application is a continuation of pending U.S. patent application Ser. No. 13/583,353, filed Oct. 2, 2012, which is a 35 U.S.C. § 371 national stage application of PCT Application No. PCT/GB2011/000343, filed on Mar. 10, 2011, and which claims priority from Great Britain Patent Application No. 1003996.4 filed on Mar. 11, 2010, the contents of which are incorporated herein by reference in their entireties.

FIELD OF THE INVENTION

The present invention relates to an improved well barrier for sealing a downhole conduit and a method of operating the well barrier.

BACKGROUND TO THE INVENTION

Well barriers such as completion isolation valves are well known. A requirement of any completion isolation valve is that the valve throughbore is maximised. Flapper valves are widely used as completion isolation valves because of their relatively compact structure. Compared to, for example, a ball valve, the reduction in the throughbore resulting from accommodation of the valve structure is minimised.

However, flapper valves have drawbacks. A conventional flapper valve only seals from one direction. To ensure bidirectional sealing, a device can be brought into engagement with the flapper valve to press the flapper against the seal seat. While this is effective, to operate the flapper valve and achieve a bidirectional seal, at least two and sometimes three control lines, such as hydraulic lines, are required.

Furthermore, conventional completion isolation and flapper valves require constant control pressure (where hydraulic pressure is used) to maintain the flapper valve in the open position. If the hydraulic pressure fails the valve closes which can cause interruptions to production or prevent intervention access to the well.

SUMMARY OF THE INVENTION

According to a first aspect of the present invention there is provided a well barrier for sealing a downhole conduit, the well barrier comprising: a housing defining a throughbore having a longitudinal axis; a valve actuator; and a flapper valve including a flapper, the flapper valve being attached to the valve actuator, the flapper valve and the valve actuator being axially movable with respect to the housing in a direction parallel to the longitudinal axis, the flapper being adapted to move from one of a throughbore open and throughbore closed positions to the other of said open and closed positions when the actuator and flapper valve move a predetermined axial distance.

In at least one embodiment of the present invention, a well barrier is provided in which axial movement of the valve actuator and the flapper valve with respect to the housing is possible. In embodiments of the invention, such an arrangement allows for simplified operation and permits the flapper valve to be normally open.

The well barrier may comprise at least one retention device. The retention device or devices may be adapted to retain the flapper valve in the throughbore open position and/or the throughbore closed position.

The well barrier may comprise a first retention device adapted to retain the flapper valve in one of said throughbore open or throughbore closed positions.

The first retention device may be fixed relative to the housing. Fixing the first retention device relative to the housing permits an arrangement to be adopted in which the exposure of moving parts to the flow of hydrocarbons is minimised, reducing the possibility of damage to the moving parts. The first retention device may be integral with the housing. The housing may comprise the first retention device.

Axial movement by the predetermined distance, in a first direction, of the actuator and the flapper valve with respect to the housing and the first retention device may release the flapper valve from retention in one of said open or closed positions, permitting the flapper valve to move to the other of said open or closed positions.

Alternatively or additionally, axial movement, in a second direction, of the actuator and the flapper valve with respect to the housing may engage the flapper valve with the first retention device, engagement with the first retention device moving the flapper valve from one of said open or closed positions to the other of said open or closed positions.

Axial movement in the second direction by the predetermined distance may engage the flapper valve with the first retention device.

The first retention device may comprise a first inner tube.

Alternatively, the first retention device may comprise a latch.

In an embodiment where the first retention device is a first inner tube this the first retention device and the housing may define a void within which the actuator may move.

The void may be a piston chamber.

In one embodiment, in moving between the throughbore open position and the throughbore closed position, the flapper valve portion moves axially downwards with respect to the tubular housing. Such an arrangement facilitates a push force being applied from surface to activate the valve.

The actuator may move under the action of an actuator force.

The actuator force may act in the direction parallel to the throughbore longitudinal axis.

The actuator force may be applied from surface.

The actuator force may be hydraulically applied. Alternatively the actuator force may be mechanically applied. Any suitable method of moving the actuator may be used.

The actuator may be a piston.

The actuator may be tubular.

The actuator may be a tubular piston.

The actuator may slide with respect to the housing.

The tubular actuator may slide along a housing internal surface portion.

The flapper valve may be mounted in an aperture defined by the actuator.

The flapper valve may be mounted to the actuator by means of a flapper valve connection.

The flapper valve may comprise the flapper valve connection. In one embodiment, in moving between the throughbore open and the throughbore closed positions, the flapper valve connection moves along an axis parallel to the throughbore longitudinal axis.

The flapper valve connection may include a biasing means, biasing the flapper to one of the open or closed positions.

In a preferred embodiment the flapper is biased to the throughbore closed position.

The well barrier may define a seal seat for forming a seal with the flapper in the throughbore closed position.

The seal seat may be defined partially or wholly by the actuator.

The seal seat may be defined partially or wholly by the first inner tube.

The seal seat may be defined partially or wholly by an end of the first inner tube.

In one embodiment, in the throughbore open position, the seal seat is protected from the flow of hydrocarbons. Such an arrangement resists damage to the seal seat during production.

In one embodiment one of the at least one retention devices protects the seal seat in the throughbore open position.

The well barrier may comprise a second retention device.

The second retention device may be adapted to secure the flapper valve in the throughbore closed position. Such an arrangement allows the well barrier to provide bi-directional sealing.

The second retention device may engage the flapper valve to secure the flapper valve in the throughbore closed position.

The second retention device may be fixed relative to the housing.

In one embodiment, continued movement of the actuator, beyond the predetermined distance, brings the flapper valve into engagement with the second retention device. Such an arrangement is particularly beneficial, because only a single actuator force, for example, is required to move the flapper valve from the throughbore open position to a throughbore closed position and then to a secure position in which the flapper valve is, for example, pressed into engagement with the seal seat.

Once the flapper valve is engaged with the second retention device, a portion of the flapper valve may be sandwiched between the second retention device and the seal seat. In this arrangement, the flapper valve can withstand pressure from above and below.

In a preferred embodiment, the flapper may be biased to the throughbore closed position.

In an alternative embodiment, the flapper may be biased to the throughbore open position.

The second retention device may be a second inner tube.

The second inner tube may be integral with the housing.

In this embodiment, engagement with the second retention device may be adapted to move the flapper between the throughbore open position and the throughbore closed position.

The actuator may be biased to the throughbore open position. Such an arrangement permits the well barrier to be normally open.

Alternatively, the actuator may be biased to the throughbore closed position by a biasing member. Such an arrangement permits the well barrier to be normally closed.

The actuator may be biased by a biasing force.

The biasing force may act in a direction parallel to the throughbore longitudinal axis. The biasing force may act in a direction opposite to the actuator force.

In one embodiment the actuator force is adapted to move the actuator against the action of the biasing force. In this embodiment, in the absence of an actuator force, the biasing force will return the actuator from the throughbore closed position to the throughbore open position. In this case the well barrier is normally open.

In an alternative embodiment the actuator force is adapted to move the actuator from the throughbore closed position to the throughbore open position against the action of the biasing force. In this embodiment, in the absence of an actuator force, the biasing force will return the actuator from the throughbore closed position to the throughbore open position. In this case the well barrier is normally closed.

The actuator may be biased by at least one resilient member.

The resilient member may be at least one spring.

The at least one spring may be at least one coil spring, at least one compression spring or at least one disc spring, or any suitable resilient member.

In an alternative embodiment, the actuator may be biased by, for example, a nitrogen precharge.

The biasing member may be located in a void defined between the second inner tubular and the housing.

According to a second aspect of the present invention, there is provided a method of closing a well barrier, the method comprising the steps of: axially moving a flapper valve with respect to a housing in a direction parallel to a housing throughbore longitudinal axis, movement of the flapper valve releasing a flapper valve flapper from retention in a throughbore open position such that once released, the flapper moves to a throughbore closed position thereby closing the well barrier.

According to a third aspect of the present invention, there is provided a method of opening a well barrier, the method comprising the steps of: axially moving a flapper valve with respect to a housing in a direction parallel to a housing throughbore longitudinal axis, movement of the flapper valve engaging a flapper valve flapper with a retention device, engagement of the flapper with the retention device moving the flapper from a throughbore closed position to a throughbore open position thereby opening the well barrier.

According to a fourth aspect of the present invention, there is provided a method of opening a well barrier, the method comprising the steps of: axially moving a flapper valve with respect to a housing in a direction parallel to a housing throughbore longitudinal axis, movement of the flapper valve releasing a flapper valve flapper from retention in a throughbore closed position such that once released, the flapper moves to a throughbore open position thereby opening the well barrier.

According to a fifth aspect of the present invention, there is provided a method of closing a well barrier, the method comprising the steps of: axially moving a flapper valve with respect to a housing in a direction parallel to a housing throughbore longitudinal axis, movement of the flapper valve engaging a flapper valve flapper with a retention device, engagement of the flapper with the retention device moving the flapper from a throughbore open position to a throughbore closed position thereby closing the well barrier.

It will be understood, that features of one aspect may be equally applicable to another aspect and are not repeated for brevity.

BRIEF DESCRIPTION OF THE DRAWINGS

An embodiment of the present invention will now be described with reference to the accompanying Figures.

DETAILED DESCRIPTION OF THE DRAWINGS

Figure 1:
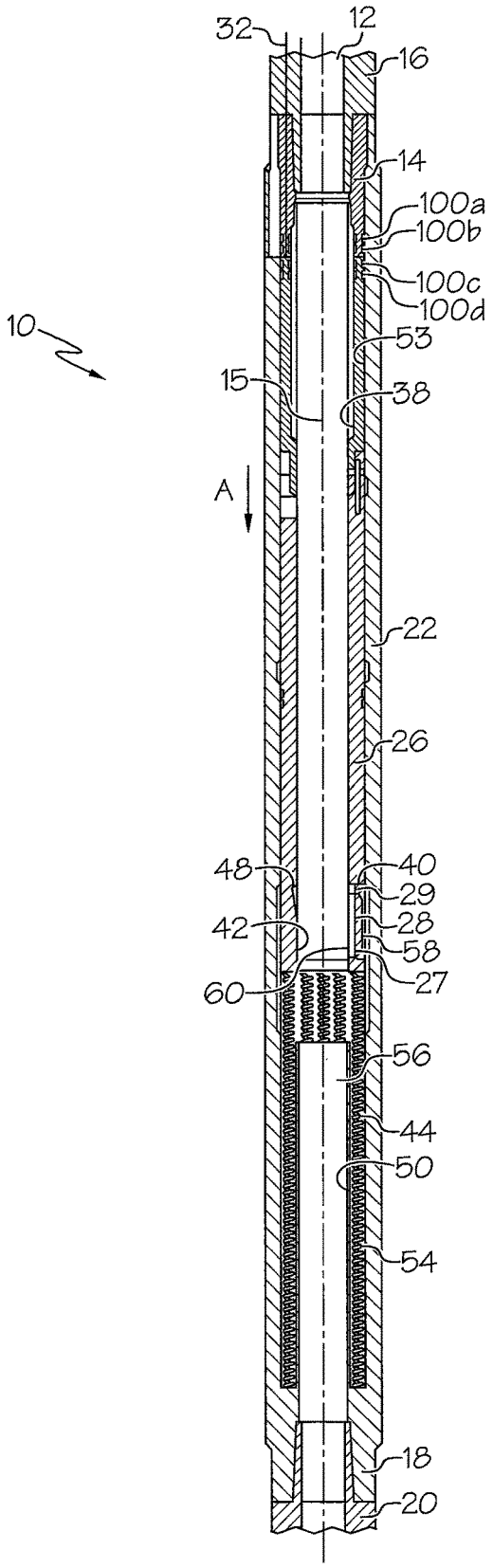
FIG. 1—a longitudinal section of a well barrier for sealing a downhole conduit according to a first embodiment of the present invention, shown in a throughbore open position.

Referring firstly to FIG. 1 there is shown a longitudinal section of a well barrier, generally indicated by reference numeral 10, for sealing a downhole conduit 12. The well barrier 10 has an upper end 14 attached to an upper length of casing 16 and a lower end 18 attached to a lower length of casing 20.

The well barrier 10 comprises a tubular housing 22 defining a throughbore 24. The well barrier 10 further comprises an actuator 26 and a flapper valve 28, having a flapper 27 for sealing the housing throughbore 24. The flapper valve 28 is attached to the actuator 26, the flapper valve 28 and the actuator 26 being axially movable together with respect to the housing 22 in an axially downwards direction (indicated by arrow A on FIG. 1) parallel to a throughbore longitudinal axis 15. The actuator 26 and flapper valve 28 are moveable with respect to the housing 22 between a first position in which the flapper valve 28 is open (FIG. 1), a second position in which the flapper valve 28 is closed (FIG. 2), and a third position in which the flapper valve 28 is closed and sealed (FIG. 3).

Figure 2:
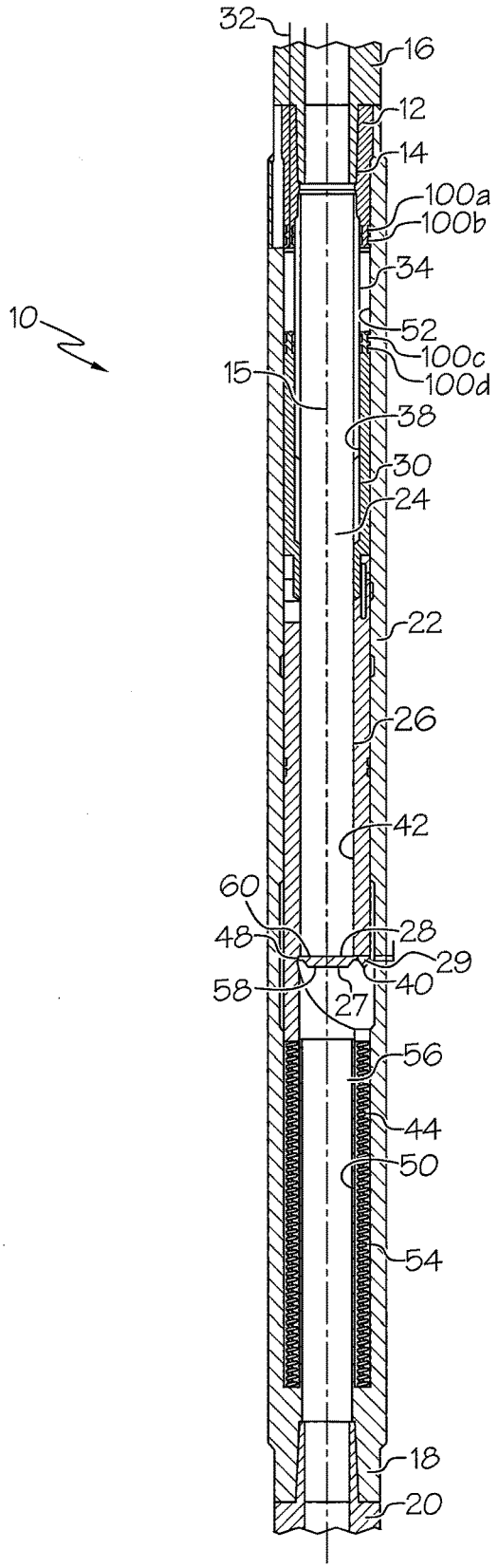
FIG. 2—a longitudinal section of the well barrier of FIG. 1, shown in a throughbore closed position, and FIG. 3—a longitudinal section of the well barrier of FIG. 1, shown in a throughbore sealed position.
Figure 3:
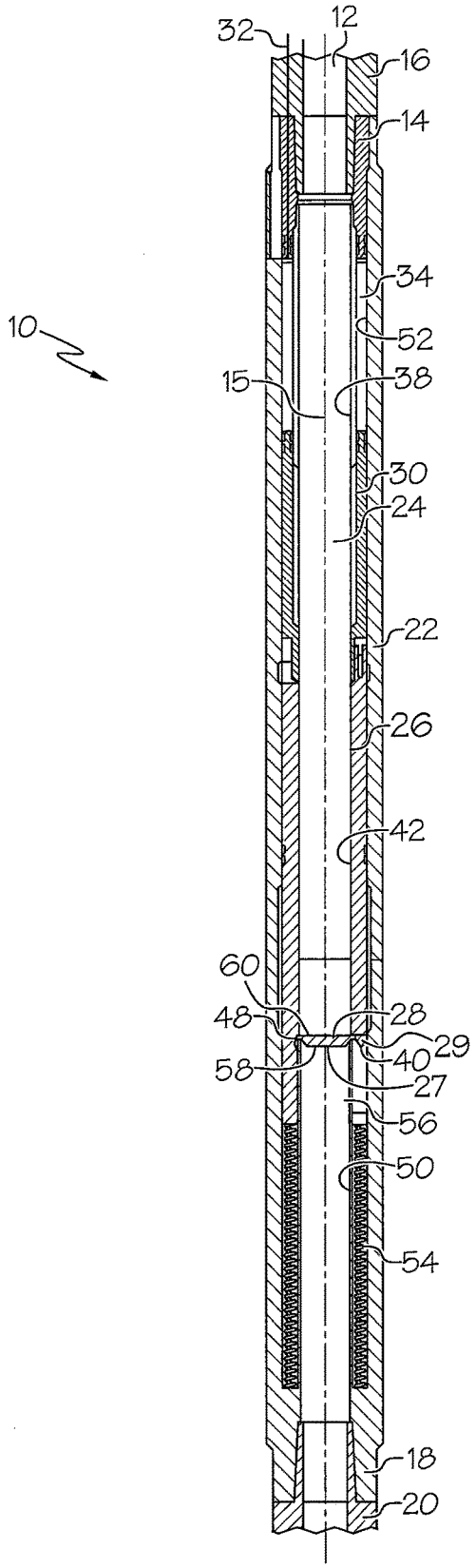

The actuator 26 comprises a tubular piston 30, the piston 30 being axially moveable in the downward direction (indicated by arrow A on FIG. 1) by the introduction of hydraulic fluid through a hydraulic line 32 into a sealed piston chamber 34, best seen on FIG. 2, the piston chamber 34 being sealed by four O-ring seals 100*a-d*. The piston chamber 34 is defined by a first inner tube 38 and the housing internal surface 52.

The flapper valve 28 is fixed to the piston 30 by a hinge connection 29. The hinge connection 29 includes a flapper valve spring 40 which biases the flapper 27 to the throughbore closed position of FIG. 2.

Referring again to FIG. 1, the flapper 27 is retained in the throughbore open position by the first inner tube 38 which acts as a retention device. The first inner tube 38 is threadedly attached to the well barrier housing upper end 14. As can be seen from FIG. 1, the lower end 42 of the first inner tube 38 holds the flapper 27 open against the action of the flapper valve spring 40. As will be described, movement of the tubular piston 30, a pre-determined distance, passed the tube lower end 42, in the direction of arrow A parallel to the throughbore longitudinal axis 15, releases the flapper 27 from retention by from the first inner tube 38, the released flapper 27 being urged by spring 40 from the throughbore open position to the throughbore closed position shown in FIG. 2.

The introduction of hydraulic fluid through the hydraulic line 32 into the piston chamber 34 moves the piston 30 in a downhole direction, indicated by arrow A. The applied hydraulic pressure has to be sufficient to overcome an axially upward force applied to the tubular piston 30 by eight compression springs 44 which act against the lower end 46 of the piston 30. The springs 40 are provided to return the piston 30 from the positions shown in FIGS. 2 and 3 to the position shown in FIG. 1 when the hydraulic pressure in the hydraulic line 32 is released. Such an arrangement ensures that, in the event of failure of the hydraulic pressure on the piston 30, the throughbore 24 will remain open because the springs 44 will return the piston 30 to the position shown in FIG. 1, in which the throughbore is open.

Referring to FIG. 2, the hydraulic pressure applied through the hydraulic line 32 into the piston chamber 34 has displaced the piston 30 sufficiently for the valve 28 to have passed the lower end 42 of the first inner tube 38 allowing the valve flapper 27 to close the throughbore 24 under the action of the valve spring 40.

Once the flapper valve 28 is shut, the flapper 27 forms a sealing engagement with a valve seat 48 defined by the piston 30. As the flapper 27 is engaged with the seat 48, the well barrier 10 is sealed against pressure acting from beneath the valve 28 that is the barrier 10 is secure for situations in which the pressure beneath the valve 28 is greater than the pressure above the valve 28. However, if the pressure above the valve 28 is greater than below then the valve 28 will open. A second inner tube 50 is provided to prevent the valve 28 opening in this situation. The second inner tube 50 is threadedly attached to the well barrier housing lower end 18, the second inner tube 50 and the housing internal surface 52 together defining a void 54 for retaining the compression springs 44.

The second inner tube 50 defines an upper end 56. Continued movement of the piston 30 in the direction of arrow A, under the action of the hydraulic pressure applied through line 32, brings a lower surface 58 of the flapper 27 into engagement with the second inner tube upper end 56 (FIG. 3). In this position, the flapper 27 is sandwiched between the seat 48, defined by the piston 30, and the second inner tube upper end 56. Such an arrangement provides a well barrier 10 in the form of a flapper valve 28 which can withstand pressure from above and below.

The well barrier 10 can be returned to the throughbore open position by releasing the hydraulic pressure in the line 32. This will permit the compression springs 44 to recover and push the piston 30 in an upwards direction, opposite to the direction of arrow A, releasing the flapper valve 28 from being locked by the second inner tube 50. Continued movement of the piston 30 forces the flapper 27 to open against the bias of valve spring 40 when the valve upper surface 60 comes into engagement with the lower end 42 of the first inner tube 38. This arrangement, of using a resilient device such as a compression spring 44 to return the piston 30 to the throughbore open position, means that only a single hydraulic line 32 is required to operate the well barrier.

Various modifications and improvements may be made to the above described embodiment without departing from the scope of the invention. For example, the arrangement of the well barrier 10 could be reversed so that the springs 44 are above the flapper valve 28, biasing the flapper valve 28 to a normally closed position in the absence of any hydraulic pressure.

What is claimed is:

1. A well barrier for sealing a downhole conduit, the well barrier comprising:

a housing defining a throughbore having a longitudinal axis;

a valve actuator comprising a piston being axially movable; and a flapper valve including a flapper, the flapper valve being attached to the piston by a hinged connection, the flapper valve and the valve actuator being axially movable with respect to the housing in a direction parallel to the longitudinal axis, the flapper being adapted to move from one of a throughbore open and throughbore closed positions to the other of said open and closed positions when the actuator and flapper valve move a predetermined axial distance, wherein the well barrier defines a seal seat for forming a seal with the flapper in the throughbore closed position, wherein the seal seat is defined partially or wholly by the actuator.

2. The well barrier of claim 1, wherein in the throughbore open position, the seal seat is protected from the flow of hydrocarbons.

3. The well barrier of claim 2, wherein the well barrier comprises at least one retention device, wherein one of the at least one retention device protects the seal seat in the throughbore open position.

4. The well barrier of claim 3, wherein the well barrier comprises a second retention device.

5. The well barrier of claim 4, wherein the second retention device is adapted to secure the flapper valve in the throughbore closed position.

6. The well barrier of claim 5, wherein the second retention device engages the flapper valve to secure the flapper valve in the throughbore closed position.

7. The well barrier of claim 4, wherein the second retention device is fixed relative to the housing.

8. The well barrier of claim 4, wherein the continued movement of the actuator, beyond the predetermined distance, brings the flapper valve into engagement with the second retention device.

9. The well barrier of claim 8, wherein once the flapper valve is engaged with the second retention device, a portion of the flapper valve is sandwiched between the second retention device and the seal seat.

10. The well barrier of claim 4, wherein the second retention device is a second inner tube.

11. The well barrier of claim 1, wherein the flapper is biased to the throughbore closed position.

12. A method of closing a well barrier, the method comprising the steps of:

axially moving a flapper valve and a valve actuator comprising a piston with respect to a housing in a direction parallel to a housing throughbore longitudinal axis, the flapper valve being attached to the piston by a hinged connection, movement of the flapper valve releasing a flapper valve flapper from retention in a throughbore open position such that once released, the flapper moves to a throughbore closed position thereby closing the well barrier, wherein the well barrier defines a seal seat for forming a seal with the flapper in the throughbore closed position, wherein the seal seat is defined partially or wholly by the actuator.

13. A method of opening a well barrier, the method comprising the steps of:

axially moving a flapper valve and a valve actuator comprising a piston with respect to a housing in a direction parallel to a housing throughbore longitudinal axis, the flapper valve being attached to the piston by a hinged connection, movement of the flapper valve engaging a flapper valve flapper with a retention device, engagement of the flapper with the retention device moving the flapper from a throughbore closed position to a throughbore open position thereby opening the well barrier, wherein the well barrier defines a seal seat for forming a seal with the flapper in the throughbore closed position, wherein the seal seat is defined partially or wholly by the actuator.

* * * * *